US005415702A

United States Patent [19]

Bishop et al.

[11] Patent Number: 5,415,702

[45] Date of Patent: May 16, 1995

[54] BLACK CHROMIUM-CONTAINING CONVERSION COATINGS ON ZINC-NICKEL AND ZINC-IRON ALLOYS

[75] Inventors: Craig V. Bishop, Lakewood; Marlinda J. Thomay, Parma; Billie J. Page, Cleveland Hts., all of Ohio

[73] Assignee: McGean-Rohco, Inc., Cleveland, Ohio

[21] Appl. No.: 116,036

[22] Filed: Sep. 2, 1993

[51] Int. Cl.[6] ..... C23C 22/08

[52] U.S. Cl. ..... 148/258; 148/267

[58] Field of Search ..... 148/258

[56] References Cited

U.S. PATENT DOCUMENTS

| | | | |
|---|---|---|---|
| 2,559,878 | 7/1951 | Johnson | 148/6.21 |
| 2,768,104 | 10/1956 | Schuster | 148/258 |
| 3,501,352 | 3/1970 | Shah | 148/6.2 |
| 3,535,168 | 10/1970 | Thompson | 148/6.16 |
| 3,647,569 | 3/1972 | Schneider | 148/6.16 |
| 3,932,198 | 1/1976 | Schneider | 148/6.2 |
| 4,141,758 | 2/1979 | Glassman et al. | 148/6.2 |
| 4,171,231 | 10/1979 | Bishop et al. | 148/6.21 |
| 4,263,059 | 4/1981 | Gudde et al. | 148/6.2 |
| 4,578,122 | 3/1986 | Crotty | 148/6.2 |
| 4,657,599 | 4/1987 | Sutherland | 148/6.2 |

FOREIGN PATENT DOCUMENTS

| | | | |
|---|---|---|---|
| 0177477 | 10/1983 | Japan | 148/258 |
| 586517 | 3/1947 | United Kingdom . | |
| 1461244 | 1/1977 | United Kingdom . | |

*Primary Examiner*—Sam Silverberg

*Attorney, Agent, or Firm*—Renner, Otto, Boisselle & Sklar

[57] ABSTRACT

A method is described for preparing a black chromium-containing conversion coating on a zinc-nickel alloy surface containing at least about 8% nickel in the alloy or on a zinc-iron alloy surface. The method of the invention comprises contacting said surfaces with an aqueous acidic solution comprising trivalent chromium and an amount of a phosphorus acid selected from phosphoric acid, phosphorous acid, hypophosphorous acid, and mixtures thereof effective to provide a solution having a pH of from about 1.0 to about 2.5. Metal articles having zinc-nickel alloy surfaces containing at least about 8 % nickel in the alloy or having zinc-iron alloy surfaces which have been treated in accordance with the method of the invention exhibit the desired blackened surfaces and are characterized by improved corrosion resistance.

15 Claims, No Drawings

BLACK CHROMIUM-CONTAINING CONVERSION COATINGS ON ZINC-NICKEL AND ZINC-IRON ALLOYS

FIELD OF THE INVENTION

The present invention relates to a method of depositing black chromium-containing conversion coatings on zinc-nickel alloy surfaces and zinc-iron alloy surfaces, and to articles having such surfaces. More particularly, the invention relates to a process for depositing black chromium-containing conversion coatings on zinc-nickel alloy surfaces containing at least about 8% nickel in the alloy and zinc-iron alloy surfaces which are free of hexavalent chromium and silver ions. The invention also relates to metal articles having such blackened surfaces. A novel method for preparing $Cr(H_2PO_4)_3$ also is described.

Various conversion coatings on metal surfaces have been suggested in the prior art for the purpose of forming a coating which protects the metal against corrosion and also serves as a base for improving the adhesion of subsequently applied siccative organic finishes. Such conversion coatings are applied by treatment of the surfaces with solutions of various chemicals which react with the surface to form the desired coating. Among the commonly used conversion coating compositions are aqueous phosphate and chromate solutions. Among the simplest of the phosphate compositions are the so-called iron phosphates which comprise, for example, solutions of alkali metal phosphates, and which react with the iron on the metal surface to form an iron phosphate coating.

It also has long been known that surfaces of zinc and zinc-based alloys can be protected against corrosion by treatment with an acid solution containing hexavalent chromium. It was suggested that the attack of the solution on the surface was facilitated if the solution initially contained a small amount of trivalent chromium, and it has been proposed to introduce this trivalent chromium by adding a compound of trivalent chromium, or preferably by adding a small amount of a suitable reducing agent. As the solutions are used, more trivalent chromium is formed by reduction of hexavalent chromium at the zinc surfaces so that the concentration of trivalent chromium progressively increases and the solution eventually has to be discarded when the quality of the coating is affected by the deterioration of the solution. Examples of patents which describe solutions containing mixtures of trivalent chromium and hexavalent chromium include U.S. Pat. Nos. 3,880,772; 3,795,549; 3,553,034; 3,404,046; 3,090,710; 2,911,332; and 2,902,392.

The treatment of zinc surfaces with solutions wherein chromium is entirely in a trivalent state is disclosed in, for example, U.S. Pat. Nos. 3,932,198; 3,647,569; 3,501,352; and 2,559,878. Trivalent chromium solutions also are disclosed in British Patent 1,461,244.

One disadvantage of hexavalent chromium type solutions is in the area of waste disposal. Emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive, and the precipitate creates a disposal problem.

Another problem which has been observed with chromate finishes which have been described previously is the unacceptable adhesion characteristics when certain paints have been applied over the chromate coatings, particularly on exposure to salt spray.

Chromate coating solutions containing trivalent chromium as substantially the only chromium ion present, fluoride ion, an acid other than nitric acid and an oxidizing agent such as an inorganic halate or peroxide have been described in U.S. Pat. No. 4,171,231. Such solutions deposit desirable light to clear blue chromate finishes.

U.S. Pat. No. 4,263,059 describes aqueous acidic chromate coating solutions for treating zinc, zinc alloy or cadmium surfaces which comprises trivalent chromium as substantially the only chromium ion present, fluoride ion and an acid wherein the coating solution is prepared by mixing a green trivalent chromium ion solution with a blue trivalent chromium ion solution having a pH of less than 1. The blue trivalent chromium solution can be prepared by dissolving a source of hexavalent chromium in water and adding a reducing agent to reduce the hexavalent chromium to trivalent chromium and thereafter adding fluoride ion and an acid to reduce the pH to less than 1. The acids may be organic acids such as acetic acid or inorganic acids such as nitric acid, sulfuric acid, hydrochloric acid, sulfamic acid and phosphoric acid.

U.S. Pat. No. 4,026,728 describes coatings for steel sheet including zinc plated steel, chromium-plated steel, aluminum-plated steel, etc. with a solution containing at least one compound selected from the group consisting of chromic acid, phosphoric acid, salts of chromium, molybdenum, silicon, cobalt, manganese, copper, nickel, aluminum and titanium, and thereafter contacting the treated steel with a solution containing at least one organic silicon compound.

U.S. Pat. Nos. 2,559,878; 3,647,569; and 3,932,198 describe solutions for coating metal surfaces which comprise trivalent chromium and nitric acid. In the '198 patent, the solutions also must contain one or more cations selected from the group consisting of manganese, bismuth, antimony, tin, zinc or molybdenum.

Black conversion coatings containing hexavalent chromium are known. One known acidic solution comprises chromic acid, silver nitrate and acetic acid. The black color results from the incorporation of the silver ion into the passivation coating. However, in view of the use of the photosensitive silver ion, under illumination at certain frequencies of light, the black color may "fade" to a green or olive drab color which in many instances is unappealing. Moreover, the costs associated with treatments involving hexavalent chromium and silver are expensive.

SUMMARY OF THE INVENTION

A method is described for preparing a black chromium-containing conversion coating on a zinc-nickel alloy surface containing at least about 8% nickel in the alloy or on a zinc-iron alloy surface. The method of the invention comprises contacting said surfaces with an aqueous acidic solution comprising trivalent chromium and an amount of a phosphorus acid selected from phosphoric acid, phosphorous acid, hypophosphorous acid, and mixtures thereof effective to provide a solution having a pH of from about 1.0 to about 2.5. Preferably, the aqueous acidic solutions are free of hexavalent chromium. Metal articles having zinc-nickel alloy surfaces containing at least about 8% nickel in the alloy or having zinc-iron alloy surfaces which have been treated in accordance with the method of the invention exhibit the desired blackened surfaces and are characterized by improved corrosion resistance.

DESCRIPTION OF THE PREFERRED EMBODIMENTS

The method of the present invention is useful in depositing black chromium-containing conversion coatings on zinc-nickel alloy surfaces and zinc-iron alloy surfaces, and more particularly, on zinc-nickel alloy surfaces containing at least about 8% nickel in the alloy. The alloys may contain up to about 20% of nickel. Specific examples of zinc-nickel alloys which can be provided with a black chromium-containing conversion coating include zinc-nickel alloys containing 10% nickel, zinc-nickel alloys containing 12% nickel, zinc-nickel alloys containing 16% nickel, etc. Zinc-iron alloys contain small amounts of iron such as from about 20 to 1000 ppm.

The aqueous acidic solutions which are useful in the method of the present invention comprise trivalent chromium and an amount of a phosphorus acid selected from phosphoric acid, phosphorous acid, hypophosphorous acid, and mixtures thereof which is effective to provide a solution having a pH of from about 1.0 to about 2.5. The solutions can contain from about 1 to about 20 grams of trivalent chromium per liter of solution and more often will contain from about 3 to about 15 g/l of trivalent chromium. The trivalent chromium contained in the aqueous acidic solutions may be derived from a number of sources including chromium (III) sulfate, chromium (III) nitrate, chromium (III) phosphate, chromium (III) acetate, etc.

Alternatively, the trivalent chromium can be prepared by the reduction of an aqueous hexavalent chromium-containing solution. Various water-soluble or water-dispersible sources of hexavalent chromium may be used in the preparation of the trivalent chromium solution provided that the anions or cations introduced with the hexavalent chromium do not have a detrimental effect on either the solution itself or on the zinc-nickel or zinc-iron surfaces. Examples of hexavalent chromium materials which may be used are chromic acid ($CrO_3$), the alkali metal chromates such as sodium chromate and potassium chromate, the alkali metal dichromates such as sodium dichromate and potassium dichromate, etc.

Methods for reducing hexavalent chromium with organic and inorganic reducing agents are generally known in the art. For example, U.S. Pat. Nos. 3,063,877 and 3,501,352 describe methods for reducing chromium trioxide with aldehydes and alcohols such as formaldehyde and butyl alcohol. However, the amount of reducing agent used in accordance with those patents is insufficient for completed reduction of the hexavalent chromium as required in the present invention. Accordingly, the amount of reducing agent used in preparing trivalent chromium for use in the present invention is at least the amount required for complete reduction of the hexavalent chromium to trivalent chromium.

Among the suitable inorganic reducing agents are alkali metal iodides, ferrous salts, sulfur dioxide, hydrogen peroxide, and alkali metal sulfites, bisulfites and metabisulfites. The alkali metal bisulfites, and especially sodium and potassium metabisulfite are preferred. As mentioned above, the reducing agents are employed in amounts sufficient to completely reduce hexavalent to trivalent chromium. In general, the amount of sulfite or bisulfite employed is less than 1% excess by weight) or with the stoichiometric amount required for complete reduction of hexavalent to trivalent chromium. However, an excess of bisulfite is not detrimental to this invention.

A preferred procedure for preparing trivalent chromium solutions which may be used in the preparation of the coating solutions of the invention is described in British Patent 1,461,244 and U.S. Pat. No. 4,171,231. A source of hexavalent chromium such as chromic acid flakes is dissolved in water, and the reducing agent is added slowly to control the heat of the reaction and to maintain the reaction mixture at the desired temperature. Cooling may be required if the addition progresses too rapidly.

In one preferred embodiment, the source or trivalent chromium in the acidic solutions are chromium (III) phosphates such as $CrPO_4$, $Cr(H_2PO_4)_3$, $Cr_2(HPO_4)_3$ and $Cr_3(HPO_4)_3PO_4$. Among these phosphates, the presently preferred are $CrPO_4$ and $Cr(H_2PO_4)_3$. $CrPO_4$ can be prepared by techniques known in the art, and one example for preparing $CrPO_46H_2O$ is shown in Example A. $Cr(H_2PO_4)_3$ can be prepared by reacting chromic acid with phosphoric acid and phosphorous acid in water at the reflux temperature of the mixture in accordance with the following reaction:

$$2CrO_3+3H_3PO_4+3H_3PO_3=2Cr(H_2PO_4)_3+3H_2O$$

Sufficient phosphorous acid is used to reduce all of the hexavalent chromium to trivalent chromium. In one embodiment, the chromic acid is dissolved in water and reacted with the phosphoric acid to form an intermediate. The intermediate then is reacted with phosphorus acid. The presence of hexavalent chromium can be detected at the end of the reaction by the iodide/-chloroform method. If any hexavalent chromium is detected, a small amount of phosphorous or hypophosphorous acid is added and the mixture is refluxed for a short period to reduce the hexavalent chromium to trivalent chromium. One process for preparing $Cr(H_2PO_4)_3$ is illustrated in the following Example B.

Example A

A solution of 500 grams of chrome alum ($KCr(SO_4)_2.12H_2O$) in about 2.5 liters of deionized water is prepared and filtered to remove any undissolved solids. A solution of 178 grams of anhydrous disodium hydrogen phosphate in 500 ml of hot deionized water also is prepared by adding small portions of the phosphate salt to the water and allowing each portion to dissolve before adding the next portion. After cooling to room temperature, the phosphate solution is added to the chromium solution with stirring at a rate of about 25 ml per minute. When all of the phosphate solution has been added, the mixture is stirred for an additional 30 minutes. The violet chromium phosphate precipitate is allowed to settle and is filtered, washed with four 100 ml portions of deionized water, and then with four 100 ml portions of ethanol. The residue is vacuum dried and transferred to a drying dish where it is dried at ambient temperature for 48 hours.

Example B

Chromic acid (33.9 g) is dissolved in about 250 ml of water in a stirred reactor flask fitted with a condenser and dropping funnel. Phosphoric acid (85%, 64.5 g) is added to the solution with stirring, and a solution of 41.7 g of phosphorous acid in 100 ml of water is added slowly through the dropping funnel. The rate of addition is adjusted to obtain a gradual temperature rise to reflux.

If the exotherm is insufficient, the solution is heated to reflux. Reflux conditions are maintained for 30 minutes after all of the phosphorous acid is added. A portion of the solution is analyzed for the presence of hexavalent chromium by the iodine/chloroform method. If the test is positive, 2 g of hypophosphorous acid dissolved in a minimum amount of water is added through the condenser and the mixture is refluxed for 15 minutes. This procedure is repeated until the test for hexavalent chromium is negative. The product is cooled to room temperature.

The aqueous acidic solutions used in the present invention contain at least one phosphorus acid selected from phosphoric acid, phosphorous acid, and hypophosphorous acid. Sufficient phosphorus acid is included in the aqueous acidic solutions used in the present invention to provide a solution having a pH of from about 1.0 to about 2.5, more often, from about 1.0 to 2.0 or from about 1.2 to about 1.6. In one preferred embodiment, the phosphorus acid included in the aqueous acidic solutions is phosphoric acid, and in another embodiment, the phosphorus acid is a mixture of phosphoric and hypophosphorous acids.

The aqueous acidic solutions useful in the present invention may be prepared by mixing one or more trivalent chromium salts with one or more phosphorus acids in water. The amount of the trivalent chromium included in the aqueous acidic solutions may be varied over a wide range, and generally, the solutions will contain from about 1 to about 20 grams of trivalent chromium per liter of solution, and more often, from about 3 to about 15 grams of trivalent chromium per liter of solution. In one embodiment, it is preferred that the aqueous acidic solutions containing the trivalent chromium be substantially free of hexavalent chromium. Various combinations of trivalent chromium salts and phosphorus acids useful in the present invention include: $CrPO_4$ and $H_3PO_4$; $CrPO_4$ and $H_3PO_2$; $CrPO_4$ and $H_3PO_4$ and $H_3PO_2$; $CrSO_4$ and $H_3PO_4$; $Cr(H_2PO_4)_3$ and $H_3PO_4$, etc. In a preferred embodiment, the aqueous acidic solutions do not contain any hexavalent chromium. In another embodiment, the solutions are free of silver ions.

The aqueous acidic solutions of the invention optionally may contain other additives such as wetting agents or surfactants which may be cationic, anionic, nonionic or amphoteric. The amount of wetting agent included in the solutions may range from 0 to about 15 grams per liter of solution. The types of cationic wetting agents which preferably are included in the coating solutions of the invention include those derived from aliphatic amines and more particularly a series of amine-based cationic wetting agents available from the Armak Company under the general trade designations "Armohib 25", "Armohib 28" and "Armohib 31".

Anionic aromatic sulfonic acids or salts thereof may also be included in the aqueous acidic solutions. These compounds are obtained by the polycondensation of formaldehyde and an aromatic sulfonic acid which generally is a naphthalene sulfonic acid. Polycondensation products of this type are known compounds and their production has been described in the literature such, for example, Houben-Weyl, "Methoden Der Organishen Chemie", Vol. XIV/2 at page 316, and said description is hereby incorporated by reference. The utility of these condensation products in acid zinc baths is described in U.S. Pat. Nos. 3,878,069 and 4,075,066.

The general method of preparing these polycondensation products involves reaction of a formaldehyde solution with naphthalene sulfonic acid at a temperature of from about 60° C. to about 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups.

Some examples of aromatic sulfonic acids which may be used include: a soluble salt of tetrahydronaphthalene sulfonic acid such as those available commercially from DuPont; a bath-soluble salt of a xylene sulfonic acid such as those available from Arco Chemical Company under the general trade designation "Ultrawet"; and a bath-soluble salt of cumyl sulfonic acid.

These anionic aromatic sulfonic acid compounds may be introduced into the aqueous solutions either in their acid form or as the water-soluble salts which may be the sodium or potassium salts.

Polycondensation products of these types are available commercially from GAF under the general trade designations BLANCOL N and BLANCOL DISPERSANT; from BASF under the designation TAMOL NNO; from Kokko Corporation under the designation DEMOL N; and from Stepan Chemical Company under the designation STEPANTAN A.

The aqueous acidic solution may contain from 0.1 to about 10 g/l of at least one acetylenic derivative characterized by the following general formula $$R_1C{=}CCH_2OR_2$$

wherein $R_1$ is selected from H, $CH_2OH$ and $CH_2OR_2$, and $R_2$ is selected from H, $(CH_2CH_2O)_nH$, $(CH_2{-}CH(OH)CH_2)_nH$, $(CH_2)_mSO_3M$, $(CH_2CH(OH){-}CH_2)_nSO_3M$, $(CH_2CH_2O)_n(CH_2CH(OH)CH_2)_m{-}SO_3M$, and $(CH_2CH_2O)_n(CH_2)_mSO_3M$, wherein n is an integer of from 1 to 10; m is an integer of from 1 to 4; and M is selected from hydrogen, ammonium, or alkali metal provided that $R_1$ is not H when $R_2$ is H, $(CH_2CH_2O)_nH$ or $(CH_2CH(OH)CH_2)_nH$. These compounds are lower molecular weight acetylenic alcohols and diols, and their epoxide adducts, their sulfonated adducts and their alkyl ether sulfonic acid derivatives.

In a preferred embodiment, the acetylenic derivatives are obtained by sulfonating the intermediate which is obtained by reacting an acetylenic alcohol or diol with a halogenated epoxide; or reacting an acetylenic alcohol or diol with an alkylene oxide followed by reaction with a halogenated epoxide.

In one embodiment, the acetylenic derivatives are derived from acetylenic alcohols such as represented by the following formula $$RC{=}CCH_2OH$$

wherein R is hydrogen or a lower alkyl group such as methyl, ethyl, etc. Propargyl alcohol (R=H) is a preferred acetylenic alcohol starting material. In another embodiment, the acetylenic derivatives are derived from acetylenic diols, and more preferably, symmetrical acetylenic diols containing 4, 6 or 8 carbon atoms. Examples of such symmetrical acetylenic diols include: 2-butyne-1,4-diol; 3-hexyne-1,6-diol and 4-octyne-1,8-diol.

The halogenated epoxides which are reacted with the acetylenic alcohols or diols include the chloro-, bromo- and iodo-substituted propylene and butylene compounds. Epichlorohydrin is a particularly preferred halogenated epoxide. The alkylene oxide generally will be ethylene oxide, propylene oxide, butylene oxide, etc.

The intermediates which are produced by the reaction of acetylenic alcohol or diol with a halogenated epoxide contains chlorine, and the intermediate is sulfonated to substitute a sulfonic acid group for the halogen group. The reaction between the acetylenic alcohol or diol and the halogenated epoxide may be catalyzed by boron trifluoride or similar Lewis acid catalyst.

The reactions of symmetrical acetylenic diols with epichlorohydrin or with alkylene oxides followed by reaction with a halogenated epoxide are described in U.S. Pat. Nos. 3,699,016; 3,860,638; and 3,907,876, the disclosures of which are hereby incorporated by reference.

Specific examples of useful acetylenic derivatives include: propargyl alcohol, 2-butyn-1,4-diol, gamma-propynoxy propyl sulfonic acid, gamma-propynoxy beta-hydroxy propyl sulfonic acid, bis-beta-hydroxyethyl ether 2-butyn-1,4-diol, bis-beta-hydroxypropylether 2-butyn-1,4-diol, 1(gamma-sulfopropoxy)-2-butyn-4-ol, 1,4-di(beta-hydroxy-gamma-sulfonic propoxy)-2-butyne, 1,6-di(beta-hydroxy-gama-sulfonic propoxy)-3-hexyne, 1,8-di(beta-hydroxy-gamma-sulfonic-propoxy)-4-octyne.

A variety of nonionic suffactants which can be utilized in the present invention are the condensation products of ethylene oxide and/or propylene oxide with compounds containing a hydroxy, mercapto or amino group containing at least one N-H. Examples of materials containing hydroxyl groups include alkyl phenols, styrenated phenols, fatty alcohols, fatty acids, polyalkylene glycols, etc. Examples of materials containing amino groups include alkylamines and polyamines, fatty acid amides, etc.

Examples of nonionic surfactants useful in the invention include ether containing surfactants having the formula $$R—O—[(CH_2)_nO]_xH$$

wherein R is an aryl or alkyl group containing from about 6 to 20 carbon atoms, n is 2 or 3, and x is an integer between 2 and 100. Such surfactants are produced generally by treating fatty alcohols or alkyl or alkoxy-substituted phenols or naphthols with excess ethylene oxide or propylene oxide. The alkyl carbon chain may contain from about 14 to 24 carbon atoms and may be derived from a long chain fatty alcohol such as oleyl alcohol or stearyl alcohol.

Nonionic polyoxyethylene compounds of this type are described in U.S. Pat. No. 3,855,085. Such polyoxyethylene compounds are available commercially under the general trade designations "Surfynol" by Air Products and Chemicals, Inc. of Wayne, Pa., and under the designation "Pluronic" or "Tetronic" by BASF Wyandotte Corporation of Wyandotte, Mich. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L-35" is a product obtained by reacting 22 moles of ethylene oxide with polypropylene glycol obtained by the condensation of 16 moles of propylene oxide.

The following examples illustrate specific aqueous acidic solutions which are useful in the process of the present invention and which deposit black chromate coatings on zinc-nickel alloy surfaces containing at least about 8% nickel in the alloy and on zinc-iron alloy surfaces. Unless otherwise indicated in the following examples and elsewhere in the specification and claims, all parts and percentages are by weight, temperatures are in degrees Centigrade, and pressures are at or near atmospheric pressure.

TABLE

| | Aqueous Acidic Solutions | | | |
|---|---|---|---|---|
| Example | $Cr^{+3}$Salt | Conc. | P-acid | pH |
| 1 | $CrPO_4.6H_2O$[a] | 30 g/l | $H_3PO_4$ | 1.2 |
| 2 | $Cr(H_2PO_4)_3$[b] | 10% v | $H_3PO_4$ | 1.2 |
| 3 | $Cr(NO_3)_3$ | 18 g/l | $H_3PO_4$ | 1.2 |
| 4 | $Cr(NO_3)_3$ | 36 g/l | $H_3PO_4$ | 1.2 |
| 5 | Cr(OAc) | 36 g/l | $H_3PO_4$ | 1.2 |
| 6 | $CrPO_4.6H_2O$ | 20 g/l | $H_3PO_4$ | 2.2 |
| 7 | $CrPO_4.6H_2O$ | 60 g/l | $H_3PO_4/H_3PO_2$[c] | ND[d] |

[a]Product of Example A
[b]Product of Example B
[c]67 g/l of 85% $H_3PO_4$ and 67 g/l of $H_3PO_2$
[d]not determined In the method of the present invention, the zinc-nickel or zinc-iron surface usually is cleaned by chemical and/or physical means to remove any grease, dirt or oxides, although such treatments are not always required, particularly when the surface is to be treated with the aqueous acidic chromium solutions of the present invention immediately or soon after the zinc-nickel or zinc-iron alloy has been deposited on a metallic substrate. After rinsing the surface with water, the surface is contacted with the aqueous acidic solutions of the present invention. Contact may be accomplished by any of the commonly used techniques such as dipping, spraying, brushing, roller-coating, reverse roller-coating and flow coating. The aqueous compositions of the present invention are particularly useful in dipping operations. The aqueous acidic solutions axe generally maintained at a temperature of from about 10° C. to about 50° C. and more often from about 20°-35° C. or about ambient temperature. When the method of application is by dipping or immersion, a dipping or immersion time of about 10 to about 60 seconds, more often from about 15 to about 25 seconds is sufficient.

Following the treatment with the aqueous acidic solution containing trivalent chromium and phosphorus acid, the metal surface may be rinsed with water and then dried. Drying may be effected by air-blowing at room temperature or at higher temperatures, usually up to about 65° C.

The chromium-containing conversion coating produced on the zinc-nickel and zinc-iron alloy surfaces in accordance with the method of the present invention generally is black in color, and this black color is desirable for color coding of parts, for providing black surfaces in devices which require the absence of reflected light, in providing light absorbent surfaces for devices such as passive solar collectors, and for providing black surfaces for use in automated optical inspection (AOI) where the contrast between shiny deposits and the black coating are easy to discern using AOI equipment. In addition to furnishing the desired black surface, the aqueous acidic compositions of the present invention containing trivalent chromium and a phosphorus acid provide improved corrosion resistance and paint adhesion.

The following examples illustrate a method of coating zinc-nickel and zinc-iron surfaces with the aqueous acidic compositions.

Example I

Steel panels coated with a zinc-nickel alloy containing about 12% nickel in the alloy are immersed in the aqueous acidic solution of Example 2 for about 15 to 30 seconds while maintaining the temperature of the solution at about 21° C. whereupon a black chromium-containing conversion deposit is formed on the surface. The panels are removed from the solution, rinsed with water and allowed to dry at room temperature. The dried panels are subjected to a 5% neutral salt spray environment and are inspected for corrosion. The length of time required to develop white corrosion over 5% of the steel panel is observed and recorded. Corrosion at the edges of the panel is ignored. In this example, the development of white corrosion over 5% of the panel is not observed until at least 192 hours.

Example II

The procedure of Example I is repeated except that the panels contain a coating of zinc-iron alloy. The panels prepared in this manner were able to withstand the salt spray environment for 48 hours before 5% of the surface of the panel exhibited corrosion.

Example III

The procedure of Example I is repeated except that the steel panels are immersed in the aqueous acidic solution of Example 1. A black chromium-containing conversion coating is obtained, and the coated panel is exposed to the 5% salt spray environment for 24 hours before 5% of the surface of the panel exhibits white corrosion.

Example IV

The procedure of Example I is repeated except that the steel panels are coated with zinc-nickel alloy containing 16% nickel and the aqueous solution of Example 6 is used. An excellent black coating is obtained at temperatures within the range of about 24° C. to about 34° C.

Example V

The procedure of Example IV is repeated except that the aqueous acidic solution of Example 7 is used. An excellent black, uniform and adherent coating is deposited.

After the metal article has been treated to provide a black chromium-containing conversion coating, it is often desirable to treat the black chromium-containing coated metal parts with a silicate solution to deposit a silicate coating over the black surface. The silicate treatment results in a coated article having improved corrosion resistance. The metal articles are immersed in a silicate solution, preferably an ammonium or alkali metal silicate solution such as sodium or potassium silicate solution with a concentration of from about 1% to about 50% by weight, preferably from about 1% to about 15% by weight. The temperature of the silicate solution is in the range of from ambient temperature up to about 95° C. (200° F.), more often in the vicinity of about 55°–60° C. The metal article is immersed in the silicate for a period of from about 10 to about 90 seconds or higher. The silicate treated article then is dried in a suitable manner, and the article may be rinsed prior to drying if desired.

The following example illustrates the method of the present invention wherein a zinc-nickel surface is coated with a black chromium conversion coating and a silicate coating.

Example VI

Steel panels coated with a zinc-nickel alloy containing about 12% by weight of nickel in the alloy are immersed in a 15% v solution of the $Cr(H_2PO_4)_3$ product of Example B until a uniform black color is achieved. One-half of the panel is immersed in an aqueous solution containing 5% v of sodium silicate (PQ Corp.) and 0.1 g/l of Blancol N wetting agent at about 58° C. (135° F.) for one minute. The panels are removed and allowed to dry. No leaching of the black color by the silicate solution is observed. The panels are cut in half so that one-half is sodium silicate treated and the other half is not treated with silicate. Both halves are placed in a salt spray cabinet. The half panel which is not silicate treated develops white corrosion over 5% of the surface in about 168 hours. The half panel treated with the silicate does not develop corrosion over 5% of its surface until 288 hours of exposure.

After a metal article has been treated in accordance with the method of the present invention (with or without a silicate treatment), it often is preferred to apply an organic coating composition which may be a siccative coating such as a paint, lacquer, varnish, synthetic resin, or enamel, or electrostatically deposited powder coating. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction. The coated article is dried in a manner best suited for the siccative coating composition employed such as by air-drying at ambient or elevated temperature, baking in an oven, or baking under infrared lamps. In most instances, the thickness of the dried film of the siccative organic coating composition will be from about 0.1 to about 10 mils, and more often between 0.3 to about 5 mils.

From the above description, it will be apparent that the advantages which are obtained from this invention include the ability to produce black chromium-containing conversion coatings while eliminating the use of hexavalent chromium and photosensitive silver compounds; the ability to evaluate the black chromium-containing conversion coating and subsequently applied siccative organic coatings by automated optical inspection (AOI); improved corrosion resistance; and good paint adhesion.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method of depositing a black chromium-containing conversion coating on a zinc-nickel alloy surface containing at least about 8% nickel in the alloy, or on a zinc-iron alloy surface which comprises contacting said surfaces with a hexavalent chromium-free aqueous acidic solution at a temperature of from about 20° C. to about 35° C., said solution comprising trivalent chromium, and an amount of a phosphorus acid selected from phosphoric acid, phosphorous acid, hypophosphorous acid, and mixtures thereof which is effective to provide a solution having a pH of from about 1.0 to about 2.5.

2. The method of claim 1 wherein the aqueous acidic solution comprises a trivalent chromium phosphate and a phosphorus acid.

3. The method of claim 2 wherein the chromium phosphate is selected from $CrPO_4$, $Cr(H_2PO_4)_3$, $Cr_2(HPO_4)_3$ and $Cr_3(HPO_4)_3(PO_4)$.

4. The method of claim 1 wherein the phosphorus acid is phosphoric acid or a mixture of phosphoric and hypophosphorous acids.

5. The method of claim 2 wherein the trivalent chromium phosphate is characterized by the formula $$Cr(H_2PO_4)_3$$

and the aqueous acidic solution is free of hexavalent chromium.

6. The method of claim 1 wherein the pH of the aqueous acidic solution is from about 1.2 to about 1.6.

7. A method of depositing a black chromium-containing conversion coating on a zinc-nickel alloy surface containing at least about 8% nickel in the alloy or on a zinc-iron alloy surface which comprises contacting said surfaces with a hexavalent chromium-free aqueous acidic solution at a temperature of from about 20° C. to about 35° C., said solution comprising $Cr(H_2PO_4)_3$ and an amount of a phosphorus acid selected from phosphoric acid, phosphorous acid, hypophosphorous acid, and mixtures thereof effective to provide a solution having a pH of from about 1 to about 2.

8. The method of claim 7 wherein the phosphorus acid is phosphoric acid or a mixture of phosphoric and hypophosphorous acids.

9. The method of claim 7 wherein the aqueous acidic solution contains from about 3 to about 15 grams per liter of trivalent chromium.

10. The method of claim 1 wherein the surface which has been contacted with the aqueous acidic solution comprising trivalent chromium and a phosphorus acid is subsequently contacted with an alkali metal silicate solution.

11. The method of claim 10 wherein the silicate solution is a sodium silicate solution containing from about 1% to about 50% by weight of sodium silicate.

12. The method of claim 7 wherein the surface which has been contacted with the hexavalent chromium-free aqueous acidic solution is further contacted with an aqueous alkali metal silicate solution.

13. The method of claim 12 wherein the alkali metal silicate solution is a sodium silicate solution containing from about 1% to about 50% by weight of sodium silicate.

14. The method of claim 7 wherein the surface which has been coated with the chromium-containing conversion coating is coated with a siccative organic coating composition.

15. The method of claim 12 wherein the surface which has been contacted with the aqueous acid solution and the silicate solution is coated with a siccative organic coating composition.

* * * * *